United States Patent [19]

Johnston

[11] Patent Number: 4,841,708

[45] Date of Patent: Jun. 27, 1989

[54] BOLTED ALUMINUM SHORING FRAME

[75] Inventor: Ronald J. Johnston, Georgetown, Canada

[73] Assignee: Aluma Systems Incorporated, Downsview, Canada

[21] Appl. No.: 115,587

[22] Filed: Oct. 26, 1987

Related U.S. Application Data

[63] Continuation of Ser. No. 660,564, Oct. 15, 1984, abandoned, which is a continuation of Ser. No. 249,732, Mar. 31, 1981, abandoned.

[30] Foreign Application Priority Data

Sep. 29, 1980 [CA] Canada ..... 361888

[51] Int. Cl.[4] ..... E04G 1/12

[52] U.S. Cl. ..... 52/646; 249/18

[58] Field of Search ..... 52/646, 638, 648, 633; 403/189, 190, 171, 235, 237; 14/3, 13, 14; 211/191, 192, 193; 249/18, 24; 248/235, 239, 243, 244

[56] References Cited

U.S. PATENT DOCUMENTS

| | | | |
|---|---|---|---|
| 792,366 | 6/1905 | Taylor | 403/237 |
| 1,360,131 | 11/1920 | Miller | 52/637 |
| 1,791,827 | 2/1931 | Milburn | 52/693 |
| 2,117,095 | 5/1938 | Irwin | 403/237 |
| 2,201,608 | 5/1940 | Causey | 182/178 |
| 2,294,240 | 8/1942 | Pollman | 52/637 |
| 2,468,186 | 4/1949 | Perret . | |
| 2,716,576 | 8/1955 | Nordone | 403/49 |
| 2,804,673 | 9/1957 | Fex . | |
| 2,810,612 | 10/1957 | Weisz . | |
| 2,846,085 | 8/1958 | Johnson . | |
| 2,849,258 | 8/1958 | Crook . | |
| 2,990,203 | 6/1961 | Grover et al. | 182/179 |
| 3,034,812 | 5/1962 | Causey | 403/49 |
| 3,190,405 | 6/1965 | Squire | 52/637 |
| 3,383,821 | 5/1968 | Gatch | 52/648 |
| 3,456,966 | 7/1969 | Muller | 403/237 |
| 3,684,058 | 8/1972 | Brown | 182/178 |
| 3,685,665 | 8/1972 | Atwater | 211/191 |
| 3,782,048 | 1/1974 | Corman | 52/738 |
| 3,787,020 | 1/1974 | Avery . | |
| 3,867,045 | 2/1975 | Beals | 403/190 |
| 3,966,164 | 6/1976 | Dashew . | |
| 4,036,466 | 7/1977 | VanMeter | 182/184 |
| 4,106,256 | 8/1978 | Cody . | |
| 4,131,204 | 12/1978 | Jacoby | 211/192 |
| 4,136,785 | 1/1979 | McDevitt | 182/178 |
| 4,156,999 | 6/1979 | Avery . | |
| 4,291,784 | 9/1981 | Moses | 182/178 |
| 4,462,197 | 7/1984 | D'Alessio | 182/178 |

FOREIGN PATENT DOCUMENTS

| | | | |
|---|---|---|---|
| 205507 | 11/1956 | Australia | 52/239 |
| 551811 | 1/1958 | Canada . | |
| 0648075 | 9/1962 | Canada | 403/49 |
| 957819 | 11/1974 | Canada | 52/646 |
| 263317 | 7/1968 | Fed. Rep. of Germany . | |
| 1901880 | 7/1969 | Fed. Rep. of Germany . | |
| 2302561 | 7/1974 | Fed. Rep. of Germany . | |
| 1123790 | 9/1956 | France . | |
| 1229330 | 9/1960 | France | 182/179 |
| 2454011 | 12/1980 | France | 256/65 |
| 0571618 | 4/1973 | Switzerland | 52/731 |
| 1018706 | 2/1966 | United Kingdom | 182/179 |
| 1185169 | 3/1970 | United Kingdom | 182/62.5 |

OTHER PUBLICATIONS

"Reynolds Metals Company", Louisville, Ky., 1950, pp. 21 and 46.

Advertising Brochure-Waco-Copyright 1971.

Advertising Brochure-Patent Scaffolding Co.-"Interform", Copyright 1982.

Advertising Brochure-Patent Scaffolding Co.-"Interform 30KA", undated.

Advertising Brochure-Patent Scaffolding Co.-"Interform 30K", Copyright 1981.

*Primary Examiner*—John E. Murtagh

*Attorney, Agent, or Firm*—Arnold, White & Durkee

[57] ABSTRACT

A frame for supporting vertical loads and an aluminum tubular leg for such frame is disclosed. The legs are joined by a brace arrangement and connectors are used for mechanically connecting the brace arrangement to the legs for stabilizing the legs when under load. Each of the legs has spaced portions which are substantially symmetrical about a plane containing the longitudinal axes of the frame legs and which provide areas for mechanical connection of the brace arrangement to the leg. Such mechanical connection of the frame provides a versatile frame which may be used in concrete forming work and which may be readily repaired.

12 Claims, 7 Drawing Sheets

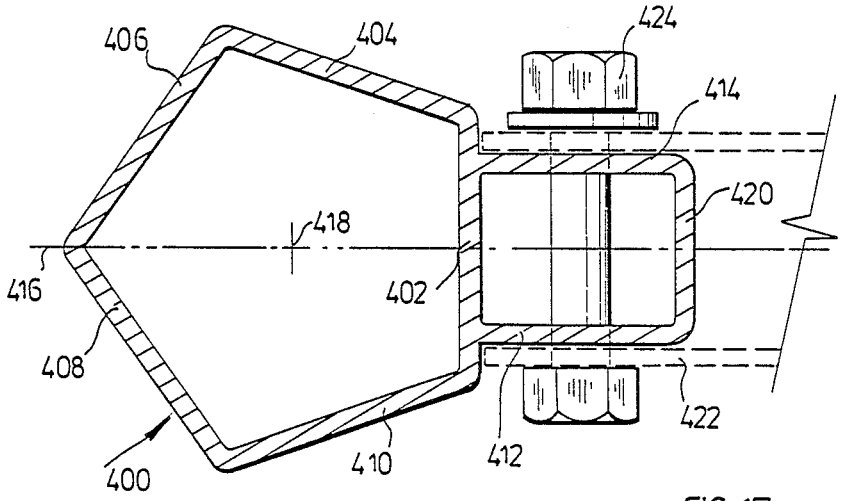
FIG .17.
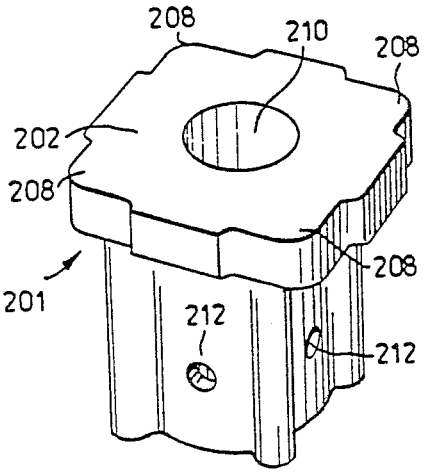
FIG .18
FIG .19.
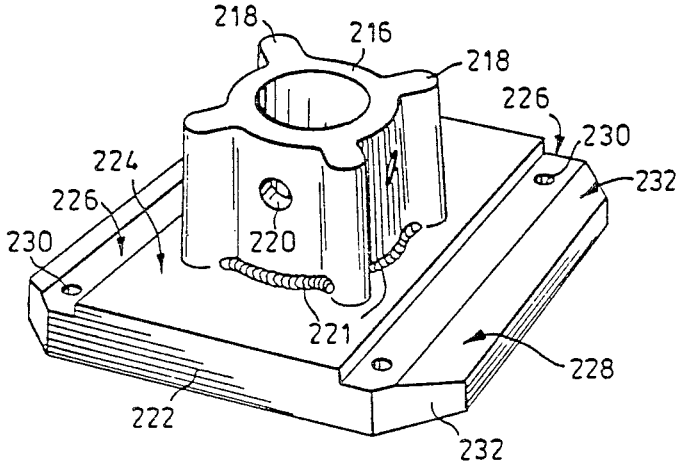

BOLTED ALUMINUM SHORING FRAME

This is a continuation of co-pending application Ser. No. 660,564 filed on Oct. 15, 1984, now abandoned, which is a continuation of application Ser. No. 249,732, filed Mar. 31, 1981, now abandoned.

FIELD OF THE INVENTION

This invention relates to vertical load supporting frames and legs therefor and, more particularly, to frames and legs which may be used in the concrete forming industry.

BACKGROUND OF THE INVENTION

In the field of concrete forming, several structures are available for supporting panels which define floor areas onto which concrete is poured. In situations where there is sufficient area surrounding the building being constructed and the construction is above ground, a large scale concrete forming structure of the type disclosed in Avery, U.S. Pat. No. 3,787,020 issued Jan. 22, 1974 is advantageously used. Such structures can be rolled out from underneath a poured set floor, raised by crane and placed on the freshly set floor to support panels defining the next floor. Such concrete forming structure is made of aluminum beams and truss components having hinged screw jacks associated with the lower portion of the structure to facilitate levelling of the forming structure prior to pouring and removal of the structure from under the set concrete floor.

Other types of aluminum structures, which are used in the concrete forming industry, are, for example, disclosed in Dashew, U.S. Pat. No. 3,966,164 issued June 29, 1976. The patent discloses an adjustable truss support, wherein a bolted truss has vertical column members forming components of the trusses. Lower column members may be inserted in the trusses to provide supports having height adjustment and force determination so as to be able to support the truss loads. The truss construction is not entirely of aluminum and, in particular, the column members are made of steel. The choice of steel is because of its strength characteristics compared to aluminum. This results in a structure having mixed materials with some chance of galvanic corrosion.

Van Meter, U.S. Pat. No. 4,036,466 issued July 19, 1977, discloses concrete shoring structure which may be moved about by use of a crane. The structure comprises corner posts spaced in quadrilateral relationship, supporting pairs of stringers along opposed sides of the quadrilateral so formed. In the structure, a number of pins are used to secure cross-braces in two different directions where the spacing between the corner posts can be easily changed. Arrangements are made using a shackle on each post to lift the structure and telescopically engaged staffs are secured within the corner posts by pins for adjusting the height of the structure. However, the structure has limited effectiveness and, in any event, requires considerable assembly at the site. The pins in most instances are welded to the supporting structure, so that if they are damaged or broken they cannot be easily replaced or repaired in the field.

Cody, U.S. Pat. No. 4,106,156 issued Aug. 15, 1978, discloses an adjustable concrete shoring apparatus. A truss-like structure has a plurality of diagonal struts extending between pairs of back-to-back channels which form upper and lower cords of the truss. The adjustability in the Cody structure comes as a consequence of a series of holes through which bolts may be passed in the plurality of truss forming locations, by which the spacing between upper and lower cords can be adjusted, but also by which the load capacity of the truss is affected. The Cody structure is one which can be adjusted in the field, but in order for it to be manupilated by hand, it must be totally disassembled.

In situations where sub-basements, parking garage floors below ground level, and smaller scale installations where cranes of suitable capacity are not readily usable, a lightweight shoring frame is desirable for supporting structure onto which concrete floors may be poured. Such shoring frame supports stringers across which beams, such as those disclosed in U.S. Pat. Nos. 4,144,690 issued Mar. 20, 1979 and 4,156,999 issued June 5, 1979, may be placed. Commonly, such shoring frames have been made from welded steel components which, when damaged in the field, cannot be replaced so that the complete frame must be scrapped or possibly repaired or rewelding.

According to this invention, a frame is provided which may be machanically assembled and disassembled, yet when assembled provides an extremely rigid and high load-bearing capacity frame. The provision of mechanical disassembly provides for repair and/or replacement of components in the frame at the job site without the use of special welding techniques or tools. The legs of the frame are made of aluminum to provide a lightweight structure.

SUMMARY OF THE INVENTION

A frame, according to this invention, for supporting vertical loads comprises a pair of spaced aluminum tubular legs joined by a brace arrangement which is mechanically connected to the legs. The brace arrangement is adapted to stabilize the legs when under load. Each of the legs has provision for mechanical connection of the brace arrangement to the respective leg. The relationship of the connections is such to provide, when the frame is complete, a fixed mechanical connection of brace arrangement to frame legs. Each of the legs has spaced portions which are substantially symmetrical about a plane containing the longitudinal axes of the frame legs. The spaced portions provide areas for mechanical connection of the brace arrangement to the legs.

The leg for the frame may have the spaced portions extending outwardly from the leg wall away from leg axis. Fastener means mechanically connects a component to the brace arrangement which cooperates with the spaced portions to such leg. The spaced portions may be integral with the leg or a support means for such spaced portions may be secured to such leg.

The frame may have means for mechanically connecting the brace arrangement to the legs. Each leg has the spaced portions in the form of spaced wall portions which are substantially symmetrical about the plane containing the longitudinal axes of the frame. The spaced wall portions provide areas for mechanical connection of the connector means to the legs.

Each of the connector means straddles the leg for connection to the respective areas of the spaced wall portions with at least portions of the interior surface of the connector being adjacent at least corresponding portion of leg exterior surface between the spaced wall portions. This relationship provides for a fixed interconnection of brace arrangement to leg when the assembly is complete.

The leg, adapted for use in the frame according to an aspect of the invention, has spaced stepped wall portions which are substantially equidistant from the longitudinal axis of the leg and are substantially symmetrical about the plane containing the longitudinal axes of the legs when used in the frame. The stepped wall portions provide areas for mechanical connection of the connector means to the leg. At least portions of the leg exterior surface between the spaced stepped wall portions are adapted to be adjacent the interior surface of the connector means when used in mechanically connecting a brace arrangement to the leg.

The leg for the frame, in having the stepped wall portions, may be so formed to displace the areas for mechanical connection outwardly of the leg longitudinal axis to accommodate securement means without substantially obstructing the leg interior.

The aluminum leg may be formed by an extrusion process, whereby the spaced wall portions are provided along the length of a leg to accommodate and facilitate mechanical connection of components of the brace arrangement to any desired position along the leg.

BRIEF DESCRIPTION OF THE DRAWINGS

Preferred embodiments of the invention are shown in the drawings, wherein:

FIG. 17 is a cross-sectional view showing an alternative embodiment for mechanically connecting the brace arrangement to the leg;

FIG. 18 is an isometric view of an endcap assembly for the frame member;

FIG. 19 is an isometric view of a base plate assembly for the frame;

DETAILED DESCRIPTION OF THE PREFERRED EMBODIMENTS

Figure 1:
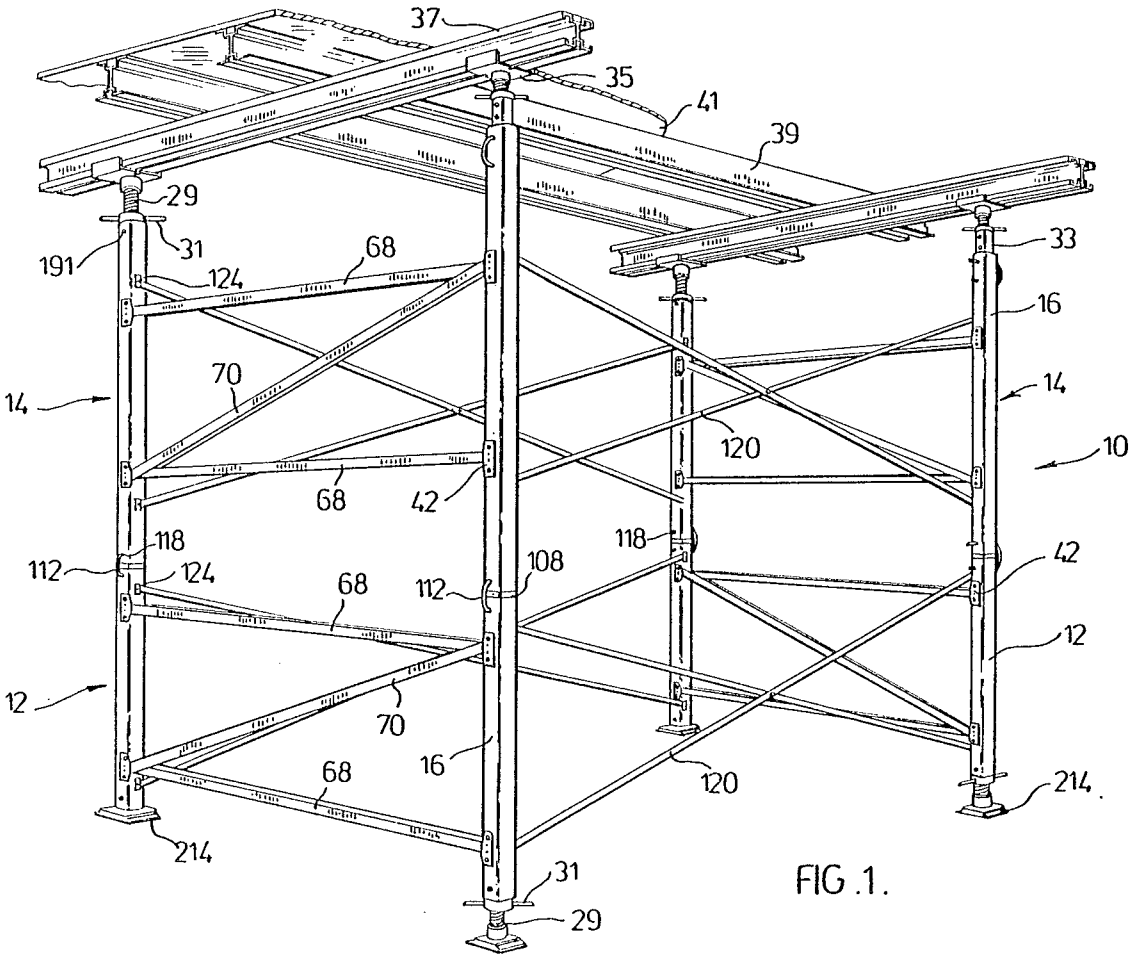
FIG. 1 is a perspective view of frames according to this invention interconnected by cross-bracing arrangements to provide supports for concrete forming structure.

The general arrangement and use for frames, according to this invention, are shown in FIG. 1. The assembly 10 comprises two sets of stacked frames 12 and 14. The difference between frames 12 and 14 is with respect to their heights; frame 12 being approximately four feet high and frame 14 being approximately six feet high.

At the upper ends of the uppermost shoring frames 14, there are endcaps in which may be inserted jack screws 29 haing handles 31, as shown at the far side of the structure of FIG. 1; or there may be extension staffs 33 inserted in the upper ends of the frame legs 16, and they may optionally carry jack screws and handles therefor at their upper ends. All of the jack screws of the upper ends terminate in U-heads 35 (or tiltable stringer supports as discussed hereafter), which suport primary members which may be stringers or beams 37, across which are placed secondary members or beams 39 which support panel 41, in the known manner.

At the lower ends of the bottom most frames, there may be placed base plates 214, as discussed hereafter, which may directly terminate at the bottom ends of frame legs 16. As shown at the far side of the structure of FIG. 1, endcaps may be used to accommodate jack screws 39 having handles 31. Alternatively extension staffs may be placed in the bottom ends of the frame legs.

Figure 2:
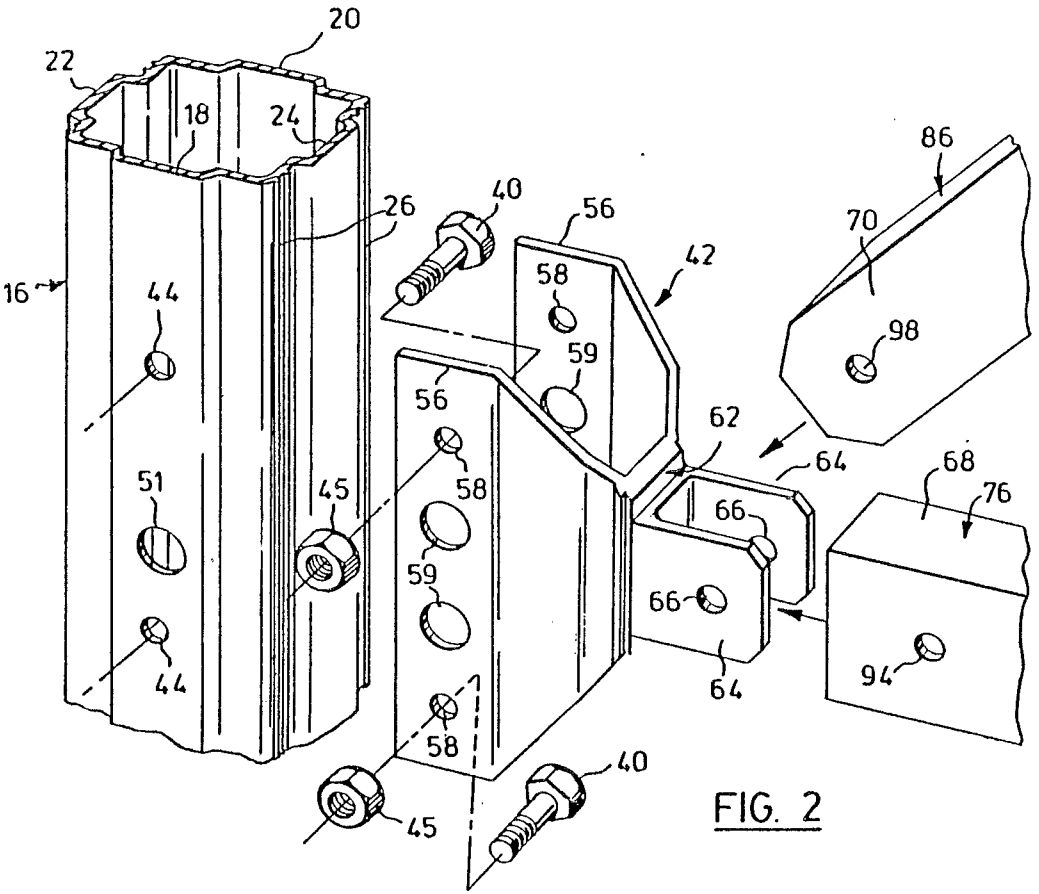
FIG. 2 is an exploded view of the assembly of bracing components to be connected to a frame leg by way of a mechanically fastenable connector.
Figure 3:
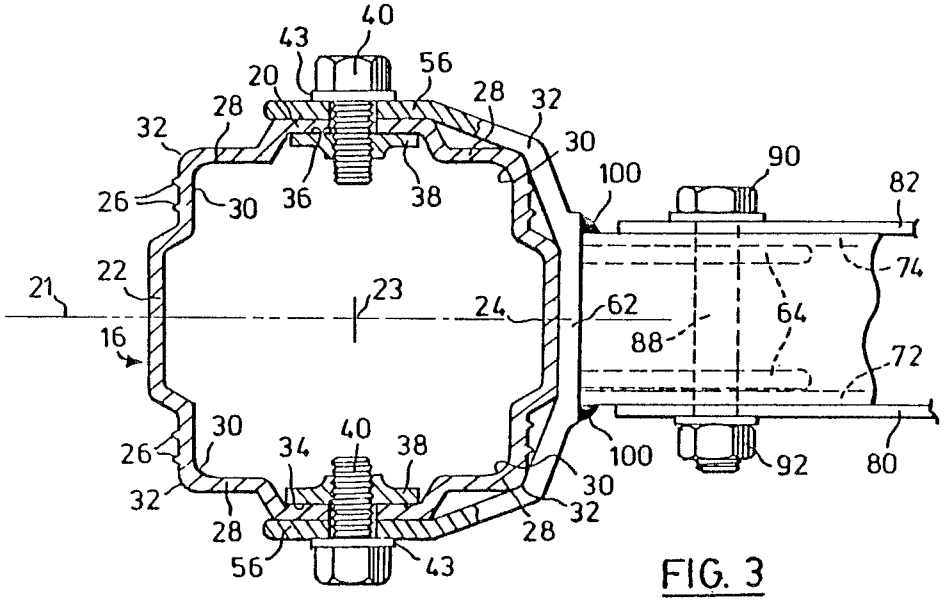
FIG. 3 is a cross-section through a leg of FIG. 2 having the connector mechanically fastened thereto, according to an alternative embodiment.

Various shapes may be provided for the frame legs and the devices for mechanically fastening the brace arrangement to the frame legs. Preferred embodiments for the shapes of the legs and connectors are shown in FIGS. 2, 9 through 12 and 18. With reference to FIGS. 2 and 3 of the drawings, this is a preferred frame leg shape and connector therefor. In the leg 16, identical faces 18 and 20 are shown (designated front and back faces) and identical faces 22 and 24 are shown (designated side faces and more specifically the outer side face and the inner side face with respect to the leg shown). On the side faces 22 and 24 are found ridges 26. Each of the front, back and side faces has a pair of shoulders 28, (on the front and back faces) and 30 (on the side faces), and ridges 26 being more specifically associated with shoulders 30. The profile of the frame leg is, therefore, substantially rectilinear with corners 32, so that the inside surfaces 34 and 36 of the front and back faces 18 and 20, respectively, are stepped forward and rearward, respectively, of the corners 32.

The stepping forward and rearward of the inner surfaces 34 and 36 of the corners 32 permits an accommodation of bolt heads 40 in FIG. 2, or fastener plates 38 in FIG. 3 for bolts 40 which pass through holes formed in the front and back faces. That is, the entire fastener 38 (or a bolt head as discussed hereafter) can be installed in such a manner, within the frame leg, without substantially obstructing insertion of another member for sliding up or down within the frame leg fitted about the corners 32.

Each frame leg 16 has a connecting bracket 42 secured to it, one near the top and bottom of each such frame leg. An exploded view of the assembly of the connecting bracket and other structure to the frame leg is shown in FIG. 2.

Two alternative methods, by which each connecting bracket may be secured to the frame leg 16 at its respective position by bolts 40 which pass through opposed pairs of holes 44 formed in each of the front and back faces of each frame leg, are shown in FIGS. 2 and 3. As shown in FIG. 3, each bolt 40 may be inserted with its bolt head at the outside of the front or back face, against a "lock" washer 43, with each bolt 40 threadedly engaged to a fastener 38. Alternatively, the bolts 40 may be passed from the inside of the frame leg 16 to the outside, engaging nuts 45, as shown in FIG. 2. Common to either arrangement is that the opposing stepped sidewalls at 34 and 36 provide areas at bolt holes 44 for mechanically fastening the connector to the leg. Such areas of connection are substantially equidistant from leg axis 23 and are substantially symmetrical about the plane 21 which contains the axes 23 of both legs in the frame.

Figure 4:
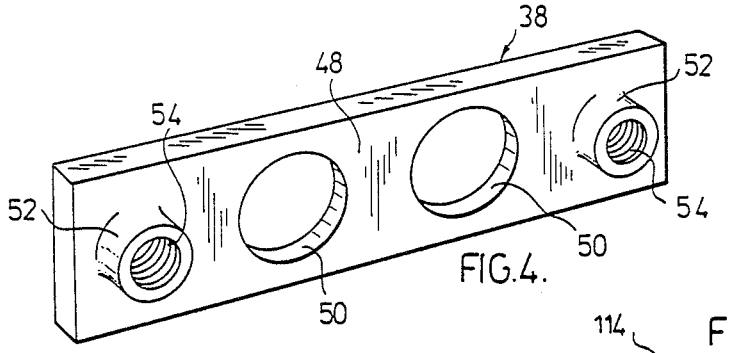
FIG. 4 is an isometric view of a mechanical fastener used in securing the connector of FIG. 3.

With specific reference to FIG. 4, the fastener 38 is shown, which serves the purpose of a bolt retaining means. The fastener 38 has a central portion 48, in which there are formed holes 50 and upstanding portions 52 which are tapped or threaded as at 54 near each end. The spacing between the neck or upstanding portions 52 is the same spacing as between the holes 44 in the front and back faces of the frame leg 16. The fastener 38 is preferably formed of steel and the neck portions 52 are formed in it by upsetting, extruding or drawing, after which they are tapped at 54. Alternatively, the fastener plate may be pierced or drilled and thereafter tapped to form the threaded portions 54 which engage the bolts 40 as referred to above. When the fastener 38 is in place, on one of the inside surfaces of the frame leg, the bolts 44 are threaded into portions 54 and tightened against lock washers 43.

The fastener 38 provides two threaded apertures which are fixed relative to one another. This facilitates the connection of both bolts 40 to the fastener, because as soon as one bolt is threaded into the fastener 38, the location of the threaded opening 54 relative to the opening 44 in the leg is aligned. In addition, the fixed relationship of the two threaded openings 54 in the fastener 38 prevent relative rotation during the threading and tightening of bolts in mechanically connecting the connecting bracket 42 to the leg 16. It is appreciated that other arrangements may be provided for the fastener 38, such as two nuts having threaded portions where the nuts are interconnected by a bar or the like to provide their fixed stationary relationship. The mating aspect of the fastener 38 with the interior of the stepped portion of the leg sidewalls also prevent rotation of the fastener device while the bolts are being tightened. Therefore, the stepped portions not only accommodate the fasteners so as to not appreciably obstruct the interior of the leg, but also in providing a mating relationship with the fastener facilitate connection of the connector to the leg.

The holes 50 in the fastener 38 are provided to mate with the hole 51 in the frame legs. The holes are provided to accommodate adaptor pins and the like which are used in interconnecting the legs in a manner to be discussed.

As is particularly noted from FIGS. 2 and 3, each connecting bracket 42 is generally U-shaped when viewed from above, having a pair of lugs or legs 56, whose spacing between the inside surfaces of the lugs is slightly greater than the distance froom front to back faces 18 and 20 of a frame leg. There is a pair of holes 58 in each leg 56 of the connecting bracket 42, the spacing between the holes 58 being the same as the spacing between holes 44 formed in each of the front and back faces 18 and 20 of each frame leg. The connection of each connecting bracket 42 to each frame leg is effected by means of bolts 40 and nuts 45 threaded thereto, or bolts 40 into connector of fastener plates 38. Another pair of holes 59 is also formed in each leg 56 of each connecting bracket 42, one of each of which registers with the hole 51 in the frame leg 16. Thus, it is seen that there is no designated up or down direction, nor a designated left or right end, for each connecting bracket 42.

The U-profile of each connecting bracket 47 is such that a base 62 is centrally located between the lugs 56 and is adapted to span and contact the side face 24 of the frame leg in the manner illustrated. A pair of stubs or plates 64 extends away from the base 62, in the opposite direction to the lugs 56. The connector, therefore, functions as a support for the outwardly extending spaced plates 64. The spacing between the stubs 64 is less than the spacing between the lugs 56. The stubs 64 each have a hole 66 formed in them.

The connecting brackets 42 are preferably formed of extruded aluminum and are afterwards cut and drilled so as to have the side profile, as illustrated in various Figures of the drawings. The integrity of the connecting bracket as an extruded piece is thereby assured.

As shown in FIGS. 1, 2 and 3, each frame is assembled by mechanically connecting a pair of tubular horizontal braces 68, secured between and cooperating with a brace arrangement to the legs. The brace arrangement is constructed in a manner to stabilize the legs when the frame is under load. The brace arrangement comprises, according to this embodiment, pairs of connecting brackets 42, between opposite pairs of frame legs 16 and a diagonal brace 70 connected from the upper connecting bracket in one frame leg to the lower connecting bracket of the other frame leg. The horizontal braces 68 may be each identical to one another (except as discussed hereafter in respect of varying frame widths) and each diagonal brace 70 may be connected from left to right or right to left. It is understood, however, that other arrangements may be provided for the bracing between frame legs, as long as the required stability is provided. The ends of the components of any desired form of brace arrangement is, according to this invention, mechanically connected to the frame legs, so that the brace arrangement in its entirety or its individual components are removable from the frame legs. With the particular brace arrangement shown, the horizontal members are arranged so as to be fixedly connected to the vertical legs at a 90 degree angle thereto.

According to the embodiment of FIG. 1, each of the horizontal braces 68 is substantially a square or rectilinear tube, preferably of extruded aluminum. Each tube has front and back faces 72 and 74 and opposed top and bottom faces 76. Likewise, each diagonal brace 70 has similar front and back faces 80 and 82 and opposed top and bottom faces 86 respectively. The width and height of the diagonal braces 70 are greater than those of the horizontal braces 68.

There are two preferred alternative ways in which the horizontal braces 68 may be secured within the bolted shoring frame, particularly as to their connection to the connecting brackets 42. In the one alternative, the horizontal brace 68 is secured to the connecting bracket by a bolt 88 having bolt head 90 and nut 92 passing through holes 94 in the front and rear faces 72 and 74 of the horizontal brace 68 and through the holes 66 formed in the stubs 64 in connecting bracket 42. In the case where the tubular diagonal brace 70 is also secured to the connecting bracket, as in FIG. 3, the bolt 88 passes through holes 98 formed in the front and rear face 80 and 82 of the diagonal brace as well and the length of the bolt 88 is chosen appropriately.

Alternatively, the horizontal braces 68 may be welded to the connecting brackets 42 by a filet weld 100 made to horizontal brace 68 to the base 62 of the connecting bracket 42. These welds are shown in FIG. 3 where there is no bolted connection of the free end of horitontal braces 68; i.e. the end which does not carry one end of a tubular diagonal brace 70, to the respective connecting bracket 42.

In yet another alternative assembly, the horizontal braces 68 may be both welded and bolted to the connecting brackets 42, combining all of the details discussed above.

Preferably as stated, each of the frame legs 16, horizontal braces 68, connecting brackets 42 and the diagonal brace 70 of each frame is formed of extruded aluminum. Suitable alloys of aluminum may include Standard Structural Aluminum Alloys 6061, 6351 and 7005 by way of example only.

A distinct advantage in the mechanical connection of a brace arrangement to the legs of the frame permits the use of a brace arrangement which may be made of materials different from the leg material. For example, the brace arrangement may be constructed of steel tubing or lightweight fibreglass. Either construction can be adapted to mate with the connectors 42 so as to be secured to the legs in the manner discussed in FIGS. 2 and 3.

Figure 7:
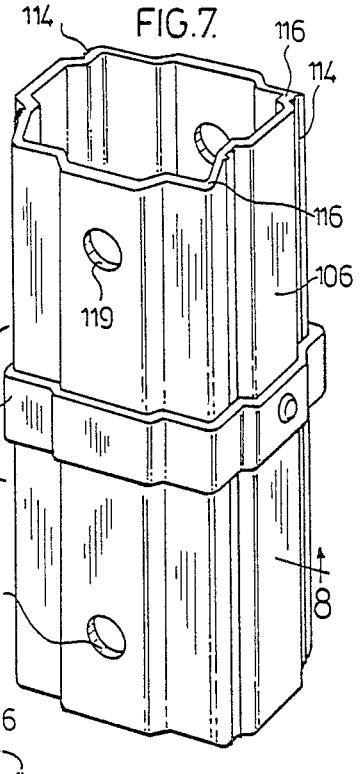
FIG. 7 is an isometric view of a frame connector for use in aligning stacked frames.
Figure 8:
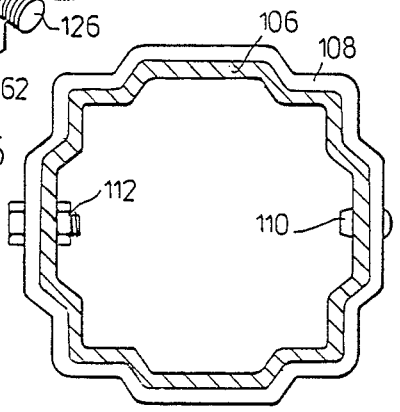
FIG. 8 is a cross-section view taken along the lines 8—8 of FIG. 7.

The means by which the shoring frames are placed in extended height relationship one to another is by way of frame connectors 104 which are shown in FIGS. 7 and 8. Each frame connector 104 comprises a length of tubing 106, preferably extruded tubular aluminum, which has a profile adapted to fit within the tubular frame legs 16, such as by means of rivets or bolts 110 or 111 (as alternatives for each other) and as indicated in FIG. 8.

The profile of the connector tube 106 is such as to fit intimately within the frame legs 16 and the length of the connector tube 106 is not so great as to extend below or above the topmost or bottommost bolts 40 securing connector brackets 42 near the ends of the frame legs being extended. There may be a plurality of ribs 114 formed on the outside faces of the connector tube 106, so that the connector tube may be more accurately centered when it is inserted into any one of the tubular frame legs 16. Also so as to accommodate the insertion of the connector tube into the tubular frame legs 16, or the placement of a tubular frame leg over the connector, the ends of the connector 104 may be chamfered as indicated at 116.

The profile of the collar 108 is such as to cause interference with the end of a frame leg 16, to thereby preclude intrusion of the collar within the frame leg and assure that the length of connector tube 106, which is above or below the colar 108, extends into the respective frame leg. In the preferred embodiment, the profile of the collar 108 is the same as the profile of the frame leg and is simply a short piece of frame leg extrusion secured to the connector tube extrusion.

A U-shaped locking pin 113 secures the frame connector into the respective upper and lower frame legs. Each lock pin 112 has two legs, one of which passes through holes 118 in the front and back faces of the appropriate frame legs and through holes 119 in the connector tubes 106, so that one leg of the lock pin 112 is above the collar 108 and the other leg is below the collar 108. In a preferred embodiment of the lock pin 112, one of the legs of the lock pin is longer than the other. Either leg, usually the longer leg, may be adapted for locking by way of a split pin or C-clip in the assembled configuration so as to preclude inadvertent disconnection of the lock pin 112 from the extended frames. Also washers (not shown) may be welded to the legs of the locking pin 112 or broached to preclude jamming of the pin into the holes 118 of frame legs 16.

Especially where the collar 108 has the same configuration as each frame leg, axial loading from an upper frame to a frame upon which it is superimposed is assured through the frame legs of each frame. Thus, more even load distribution is assured and the chances of buckling or failure of any frame leg are diminished.

So as to assemble a shoring structure of the sort shown in FIG. 1, pairs of shoring frame legs 12 or 14 are spaced apart, with pairs of cross-braces 120 extending from one of the spaced-apart pairs of frames to the other spaced-apart pair of frames in crossed relationship or formation to each other. Each cross-brace member 120 may be flat, tubular or angular in cross-section. The ends of each of the cross-brace members 120 are fitted to the respective frame leg 16 at lock assemblies 124, each of which is on a respective inner face of a frame leg near the top or bottom of each such frame leg respectively. It will be noted that the upper lock assemblies 124 on the shorter and taller frames are above the upper horizontal brace 68.

Figure 6:
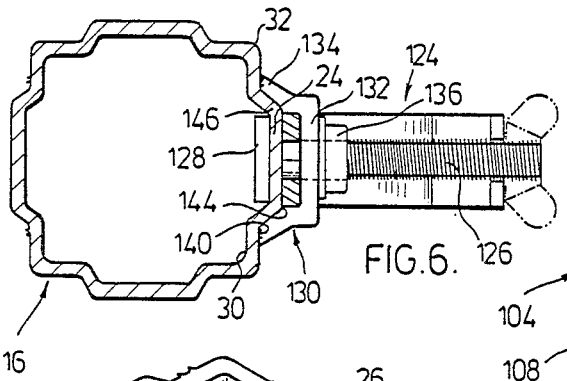
FIG. 6 is a cross-sectional view taken along lines 6—6 of FIG. 5.
Figure 5:
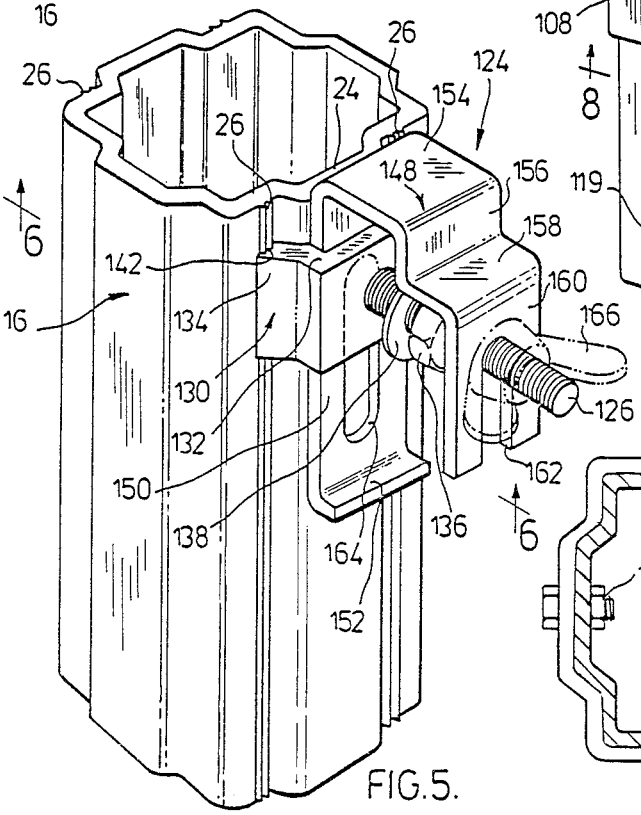
FIG. 5 shows a portion of the leg, according to this invention, having a slide lock assembly for cross-brace members secured to the leg.

The sliding drop lock or gravity lock assemblies 124 are more fully illustrated in FIGS. 5 and 6. Each sliding lock assembly 124 includes a bolt 126 (also referred to as a drop-lock pin or post) which extends through a hole formed in the respective inner face 24, for purpose of this discussion, of a frame leg 16. Bolt 126 has bolt head 128 whose inner end is clear of a line extending between the inner faces of shoulders 30 from corners 32. A track member 130, which is a flattened U-shape having a base portion 132 and legs 134, is secured to the frame leg by a jam nut 136 (which may also include a lock washer 138) tightened against the outside surface of the base 132 of the track member 130. The ends 140 of the legs 134 of the track member 130 contact a portion of the face of the frame leg on the shoulder 30, as shown.

Preferably as indicated above, there are ridges 26 formed on each shoulder 30 and corresponding ridges or teeth 142 formed in the ends 140 of the legs 134 of the track member. The cooperation of the ridges 26 and the teeth 142 is such that, when the jam nut 136 is tightened against the base 132, a reaction occurs between the ridges 26 and teeth so as to preclude spreading of the legs 134 of the base 132. Once again, for each of assembly and manufacture, the extrusion, which is used to form the frame legs 16, is made with ridges 26 on both of the side faces thereof, so that there is no question of a lefthand or righthand extrusion being required for use as a frame leg.

It should also be noted that the underside of the track member 130 has, near the upper inner ends of each of the legs 134, a landing surface 144 which is adapted to contact a corresponding portion of the inner side face 24 of the frame leg at 146, when the track member 130 is secured to the frame leg by tightening of the jam nut 136. Positive force transmission from the track member 130 to the frame leg is thereby assured, so that any upsetting or twisting moments which may occur in the bolt 126 or against the track member 130, especially during a time when the shoring frame is either being flown or otherwise unevenly loaded, is transferred into the frame leg, whereby the security of the sliding lock assembly and the cross-brace held thereby is assured, so that there is less likelihood of damage or breakage of the sliding lock assembly.

The slide locking member 148, as particularly illustrated in FIG. 5, has an inner leg or slide portion 150. The lower end of the slide 150 at 152 is bent slightly outwardly to prevent the slide from being removed upwardly out from behind the base portion 130. At the upper end of slide 150, a transverse portion 154 is provided which is stepped at 156 to provide further transverse portion 158. At the extremity of transverse portion 158 is a depending portion 160 which has an open ended slot 162 provided therein to accommodate post or bolt 126. The relationship of the base 130 to the leg 16 is such to define a sleeve within which the slide 150 may slide up and down, where a closed end slot 164 is provided in the slide 150 to accommodate the bolt 126 to permit the slide to move up and down. Provided at the extremity of bolt 126 is a wing nut 126 which may be used to secure the slide lock in its down position. The slide lock operates in a manner such that, when in the down position, it captures the ends of the brace members which are placed over the post or bolt 120. When the slide lock is moved to its second position, the depending end 160 clears the bolt 126 sufficiently to allow the brace member free ends to be removed from the bolt, thus facilitating disassembly of the interconnected frames. The stepped portion 156 provides for positive location of two brace ends against the base portion 130, since the transverse portion 154 is sufficiently wide to accommodate two brace ends. However, should four brace ends be positioned on bolt 126, then depending portion 160 is sufficiently spaced from the base portion 130 that the four brace ends are captured between depending portion 160 and the base portion 130. Such an arrangement prevents excessive movement of the cross-brace member ends along the bolt 126.

For some applications in the concrete shoring frame, it may be required that substantially thicker cross-bracing members be used to interconnect one frame to another. In this instance, clamps may be used to clamp in various orientations thicker bracing members to the frame legs. Due to the various orientations of such braces, it is preferable that the leg be substantially square with four similar sidewalls to simplify the clamp device required to clamp a brace member to anyone side of the leg. Considering the leg of FIG. 3, it has four similar sidewalls 18, 20, 22 and 24 which approximate a square. Thus, the sidewalls are symmetrical about the plane 21 and another plane which contains leg axis 23 and is perpendicular to plane 21.

Figures 9, 10, 11, 12, 13, 14, 15, 16:
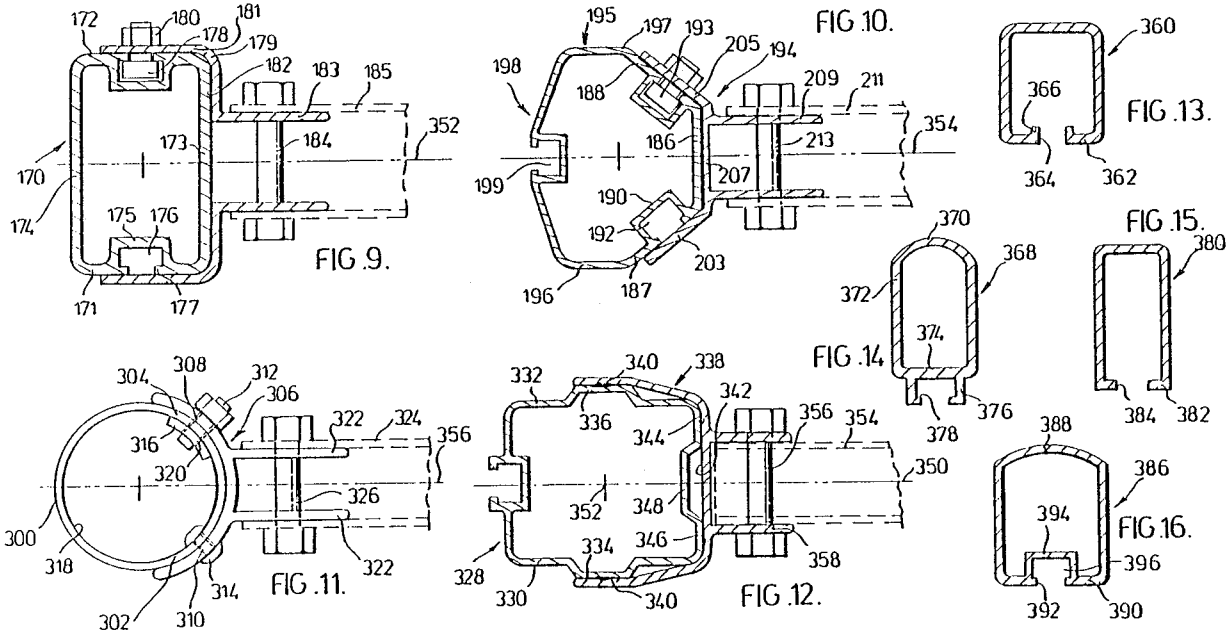
FIGS. 9, 10, 11 and 12 are cross-sectional views showing alternative embodiments for the frame leg cross-section and brace arrangement connection thereto.
FIGS. 13, 14, 15 and 16 are cross-sections showing alternative embodiments for the cross-members of the brace arrangement which provide for mechanical fastening of articles thereto.

Alternative embodiments for the leg configuration and corresponding connectors are shown in FIGS. 9 through 12. In FIG. 9, a rectangular-shaped leg 170 has opposing stepped sidewalls 171 and 172 and front and rear sidewalls 173 and 174. The opposing stepped sidewalls 171 and 172 are so formed as to provide inward stepped portions 175 which define a recess 176 and have spaced opposing projections 177. This configuration defines what is commonly referred to as a bolt slot to permit the head 178 of a bolt to be inserted in the slot, extend through an appropriate hole in the connectors 179, whereby each of the connectors 179 is secured to the leg 170 by nut 189 threaded onto the bolt and tightened thereon. The bolt has been left out of the stepped sidewall 171 for clarity in illustrating the bolt slot recessed area 176. Each connector 179 has lug portion 181 with an interior face which fits the exterior of the rectangular leg 170, such that with the connectors mechanically fastened to the legs the interior surfaces 182 of the connectors abut the exterior face of frontwall 173. The connectors 179 include outwardly projecting plate portions 183 which function in the same manner as the plate portions 64 on the connector 42 of FIG. 3. A bolt 184 is used to connect the horizontal member 185 in the manner shown.

In FIG. 10 a somewhat differently shaped leg is shown. The leg includes a frontwall portion 186 and diverging wall portions 187 and 188. The diverging wall portions 187 and 188 include stepped portions 190 which form the bolt slot recesses 192. Bolts 193 are, therefore, used to mechanically fasten the connector 194 to the leg 195. Extending rearwardly from the diverging wall portions 187, 188 are parallel sidewalls 196 and 197. A rear wall 198 interconnects the parallel walls 196, 197 and includes a bolt slot arrangement at 199.

The connector 194 has wing portions 203 and 205 which straddle the front wall portion 186 of the leg and contact the spaced stepped wall portions of walls 187 and 188. The connector 194 includes an inner portion 207 between the wings 203 and 105 which abuts the front wall portion 186 of the leg when the connector is mechanically fastened to the leg. The connector 194 includes plate portions 209 which function in the previously discussed manner for facilitating connection of a horizontal cross-member 211 to the connector 194 by use of bolt 213.

Turning to FIG. 11, a circular leg 300 is provided with spaced wall portions at 302 and 304 which provide for mechanical connection of the connector 306 to the circular leg 300. The spaced wall portions are provided in appropriate areas with apertures 308 and 310. Such apertures accommodate either bolt 312 or rivet 314 used in connecting the connector to the leg. In using the bolt 312, it is threaded into the curved plate fastener 316. The curved plate fastener 316 has the curvature of the interior 318 of the circular leg 300. The fastener has threaded aperture 320 which receives the threaded bolt 312. In tightening the bolt in the fastener, or alternatively riveting such connection, the connector 306 with its interior surface contacting the sidewall between apertures 308 and 310, is mechanically fastened to the circular leg. The connector 306 includes the spaced leg or plate portions 322 for securing horizontal member 324 to the connector by use of bolt 326.

FIG. 12 shows a somewhat rectangular leg 328 having opposing sidewalls 330 and 332 with stepped wall portions 334 and 336. The stepped wall portions provide areas to which the connector 338 may be secured by welds 340 in the manner shown. The connector 338 provides a support for the plate portions 358 which are used in the mechanical fastening of the horizontal member 354 to the leg 328. The plate portions extend outwardly from the leg wall away from its axis 352 and they are symmetrical about the plane 350. The interior surface 342 of the connector 338 abuts exterior surface portions 344 and 346 of the leg, where an inward step 348 is provided in the face of the leg 328. The wall portions 344 and 346 are symmetrical about the plane represented by dashed line 350. This plane contains the longitudinal axis at 352 of the leg and also includes the longitudinal axis of the spaced leg in the same frame, which is interconnected to leg 328 by the horizontal cross-members 354 as secured to the support 338 by bolt 356. The welds at 340 to the stepped wall portions 334 and 336 are symmetrical about the plane 350 and are equidistant from the longitudinal axis 352 of the leg. According to this embodiment, the horizontal member 354 is sufficiently narrow to fit between the plate portions 358 and have the bolt 356 fasten the cooperating portion of the member 354 to the plates 358. The support 338, therefore, provides a means whereby spaced portions in the form of plates 358 are located on the leg.

To provide for mechanical connection of the brace arrangement to the legs of the various embodiments of FIGS. 3 and 9 through 12, in each instance the following common elements are provided. The leg has spaced wall portions which are equidistant from the longitudinal axis of the leg and which are symmetrical about the plane which contains the longitudinal axes of both legs in the frame. These planes are shown in FIG. 3 at 21, in FIG. 9 at 352, in FIG. 10 at 354, in FIG. 11 at 356 and in FIG. 12 at 350. The face of the leg is adapted so as to be adjacent the interior surface of the connector, thus there is mating fit between the interior surface of the connector and the portion of leg wall between the spaced wall portions. Such contact assures a fixed interconnection of the brace arrangement to the leg, since the connector is not permitted to swivel or pivot about the fastener bolts, because of the interference between the interior surface of the connector and the face portion of the leg. In FIG. 12, portions of the leg 344 and 346 contact the interior of the connector to satisfy this requirement. In this embodiment, such portions are symmetrical about the plane 350. Alternative arrangements include providing the planar exterior surface by face portions 24 of FIG. 3, 173 of FIG. 9 and 186 of FIG. 10, which present a surface which is symmetrical about the respective planes in the noted Figures. With the circular leg 300 of FIG. 11, the surface portion against which the connector 306 contacts is circular, thus the connector is provided with a circular interior surface to mate with the exterior of the leg in facilitating mechanical fixed connection of brace arrangement to the leg.

FIGS. 13 through 16 show alternative sections for the cross-members and diagonals used in the brace arrangement for interconnecting the legs. Common to each of these configurations is the provision of a slot which is adapted to receive a bolt head to function as a bolt slot. In FIG. 14, the brace member 360 is rectangular in shape and has its bottom wall 362 provided with a slot 364 which has reinforced edges 366. An appropriate bolt head may be inserted through the slot 364, rotated 90 degrees for seating on the reinforced edges 366 to permit fastening of various articles to the brace component which may include angle reinforcing portions.

In FIG. 14, the brace component 368 has a curved upper wall 370 and straight parallel sidewalls 372. The bottom 374 has provided thereon downwardly depending lips 376 which define a bolt slot at 378 to receive a bolt head, for the reasons previously discussed.

FIG. 15 shows the brace component 380 having its bottom wall 382 provided with the slot 384 to accommodate fasteners. FIG. 16 shows a brace component 386 with curved upper wall 388. The bottom wall 390 includes a slot 392 and has an interior wall portion 394 to provide a bolt slot recess at 396.

Referring to FIG. 17, an alternative arrangement is shown for mechanically connecting a component of a brace arrangement to a frame leg. The frame leg 400 has five sidewalls 402, 404, 406, 408 and 410. In keeping with the other previously discussed embodiments of the invention, the leg has spaced portions 412 and 414 to which a cooperating component of the brace arrangement is secured. In this instance, instead of using a connector or the like to provide the spaced plate portions on the leg, the spaced portions 412 and 414 are integral with the leg. The spaced wall portions 412 and 414 are symmetrical about the plane 416 which contains the axis 418 of leg 400 and corresponding axis of the other frame leg. The integral forming of the wall portions 412 and 414 on the leg may be provided by extruding the leg with the hollow portion formed by leg wall 402, spaced walls 412 and 414 and transverse wall 420. As determined by the desired array for the brace arrangement, particular locations on the leg will be used in mechanically fastening the brace component ends to the spaced frame legs. The portions of the walls 412, 414 and 420 of the leg, apart from the connection location, may be removed from the extruded leg by standard milling techniques.

According to this embodiment, the brace member 422 has its end portion adapted so as to cooperate with the walls 412 and 414 and thereby overlap them in a manner similar to that of FIG. 3. The overlapping portions are mechanically fastened by bolt 424.

Turning to FIGS. 18 and 19, endcap assembly and base plate portions are shown. The endcap is used for insertion in an open end of the frame leg to provide support for a jack screw, such as 29 shown in FIG. 1, where the nut portion with handles rest on the outer face of the endcap. The base plate is used for insertion in the bottom of the open end of the frame to support the bottom end of the shoring frame against a mill, a previously formed concrete floor, graded earth or such other foundation on which the shoring frame assembly may stand and support the loads to which it may be subjected. Turning to FIG. 18, an endcap assembly 201 has a plate 202 and a tubular staff 204, which is welded to the underside of plate 202. The tube 204 is substantially circular and has four equidistant spaced lugs 206 at its periphery. The plate 202 may be configured at each corner 208 so as to substantially match the profile of a frame leg 16, but of a slightly greater dimension. The dimensions of the tube 204 are such that it will extend into a frame leg 16, and the lugs 207 position and secure the tube in place by their cooperation with the corners 32 of the leg. A hole 210 is formed in the plate 202 to accommodate the screw of the screw jack as it extends through the hole 210. Conveniently the plate 202 is extruded so that no additional fabricating steps other than welding, or placing the insert 206 are required. Holes 212 are formed around the periphery of the tube 204, spaced between the lugs 207, so that the endcap assembly 201 may be secured in place to the frame leg by pins or bolts, if necessary.

The base plate assembly 214 of FIG. 19 is adapted to fit directly to a frame leg 16. The base plate assembly 214 has a tube 216 similar to tube 204 of the endcap assembly 201 of FIG. 18, except that it is shorter in length. The tube 216 has lugs 218, the same as lugs 207 of tube 204, and is otherwise identical to the tube 204. Holes 220 are formed for purposes of securing the base plate assembly 214 to a frame leg 16 by a pin or bolt passed therethrough.

Plate 222 is also formed of extruded aluminum material, but in this case the extrusion is formed lengthwise rather than crosswise as with plate 202 of the endcap assembly 201. The tube 216 is secured to the plate 222 by welds 221, placed around the circular peripheral portions of the tube, but not around the peripheral portions of lugs 218 where they contact the surface 224 of plate 222. The plate 222 has an upper surface 224, a pair of stepped shoulder surfaces 226, and a pair of side sloping shoulder surfaces 228. Holes 230 are formed through the thickness of plate 222 in the shoulders 226. The corners of the plate 222 may be chamfered as at 232.

Figure 21:
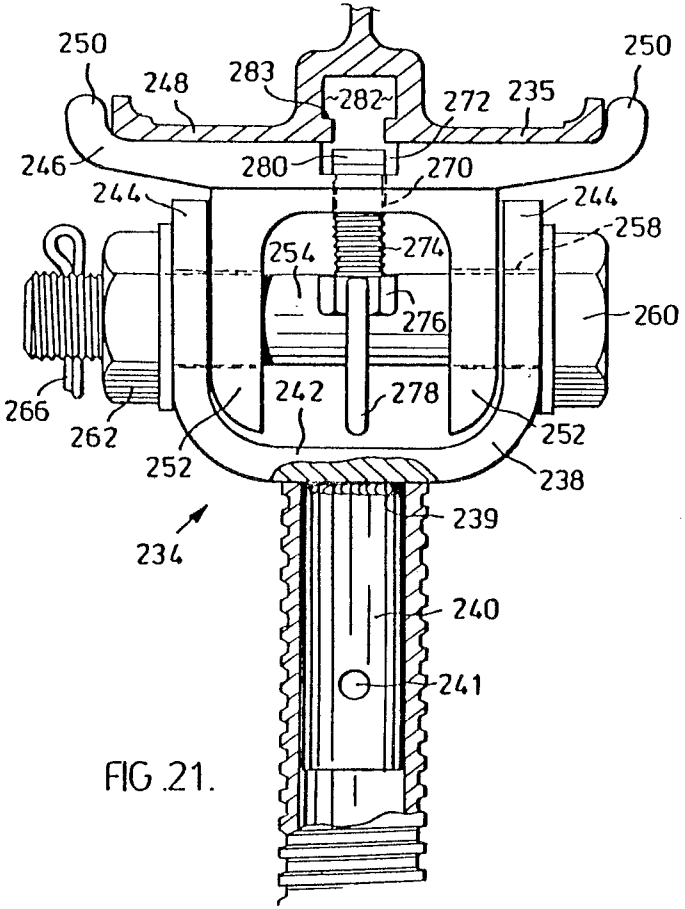
FIG. 21 is an end elevation of the tiltable stringer support of FIG. 19.
Figure 20:
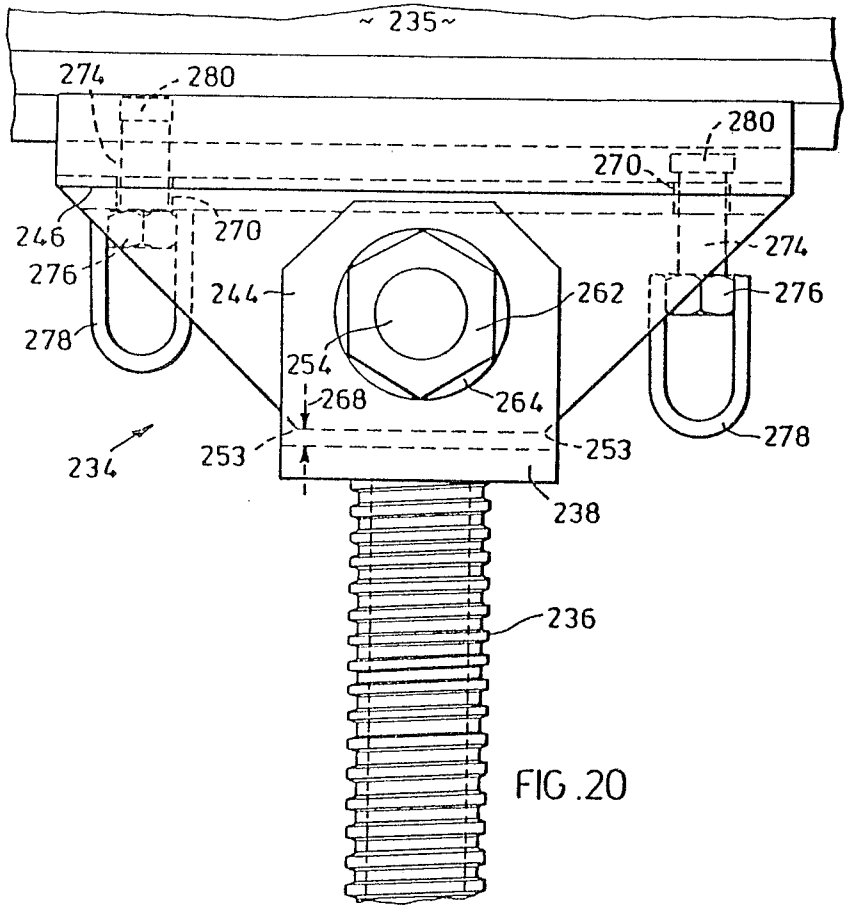
FIG. 20 is a side elevation of a tiltable stringer support for connection to the top fo a support frame.

Turning now to FIGS. 20 and 21, there is shown a tiltable stringer support which is particularly adapted for use with shoring frames according to this invention, and which may also be used for other welded steel shoring frames.

The tiltable stringer support 234 is particularly adapted for use with extruded aluminum stringers having a configuration as shown in Canadian Registered Industrial Design No. 456992, issued July 23, 1979, and as shown generally at 235 in FIGS. 20 and 21.

At the upper end of a shoring leg 16, there may be installed a hollow screw 236 at the top end of which is a U-shaped bracket 238 secured (such as by welds 239) to a post 240 inserted into the screw. The post 240 and U-shaped bracket 238 may also be otherwise mounted at the upper end of a shoring frame leg by a pin passed through holes 191 in the frame leg and 241 in the post. The U-shaped bracket 238 has a base portion 242 and a pair of upwardly extending legs 244. Preferably, the U-shaped bracket is formed of steel.

Above the U-shaped bracket is a support plate 246 of extruded aluminum, having an upper surface 248 and a pair of upwardly extending lips 250, one at each side of the upper surface 248. The width of the plate 246 is greater than the width between legs 244 of the U-shaped bracket 238. A pair of downwardly extending legs 252 is formed beneath the support plate 246 and depend thereform, extending between the legs 244 of the U-shaped bracket 238.

The assembly of the support plate 246 to the bracket 238 is by way of a pin 254 which extends through the holes 256 and 258 formed in the legs 244 of the U-shaped bracket 238 and the downwardly depending legs 252 of the support plate 246. The pin has a head 260 at one end thereof and is threadably secured in place by a nut 262 and a washer 264 at the end. A split pin 266 may also be installed, as shown.

The support plate 246 and its depending legs 252 are rotatably mounted on the pin 254. The amount of rotation of the support plate 246 around the pin 254 is determined by the inteference of the bottom of one or the other of the ends 253 of the depending legs 252 with the base 242 of the U-shaped bracket 238. This is accommodated by the fact that the distance that the lower edges of the legs 252 are below the pin is less than the distance that the upper side of the base 242 is below the pin, leaving a space 268 between them. As the support plate rotates, there will be an interference of one of the ends 253 of legs 252 will the bracket 238.

The manner by which the stringer may be secured to the tiltable stringer support is as follows. At least one hole, preferably a pair of holes 270, is formed and extend through the support plage 246 on the centre line thereof. Preferably also, a slot 272 is formed along the centre line of the support plate, with the holes 270 extending into the slot, one near each end thereof. A T-head bolt 274 may be secured within the slot 272, having a nut 276 which has a turning handle 278 welded thereto, threadedly engaged to the shank of the bolt 274. When it is desired that the stringer be secured to the stringer support, the bolt 274 is lifted upwardly so that its head 280, having a crosswise dimension which permits it to pass into the bolt slot 282 of the stringer 235 and a lengthwise dimension which interferes with the shoulders 283 of bolt slot 282, is lifted into the bolt slot 282 and turned and thereafter the nut 276 is tightened on the bolt. The locked and unlocked positions of the bolt 274, nut 276 and handle 278 are shown at the left and righthand ends, respectively, of the elevation view of the tiltable stringer support in FIG. 20.

In the unlocked position, the head 280 of the bolt 274 lies entirely within the slot 272 and does not extend above the surface 248 of the support plate 246. Other flat bottom beams may, therefore, be accommodated by the tiltable stringer support.

As an alternative embodiment of the tiltable stringer support discussed above, the positions of the legs 244 of U-shaped bracket 238 and the downwardly depending legs 252 of the support plate 246 may be reversed. That is, the legs 252 may be placed outwardly of the legs 244. In that case, the limiting of rotation of the support plate 246 about the pin 254 comes as a result of the interference of the tops of the legs 244 within the underside of the support plate.

Returning to the leg 16 of FIG. 3, it has a particular shape where the sidewalls 18, 20, 22 and 24 each include a stepped portion which displaces the sidewall outwardly from the longitudinal axis 23 of the leg. The stepped portions increase the strength of each leg sidewall. It has been found that such shape for the leg, albeit non-circular, is useful in supporting loads independently of the frame. The leg, in combination with jack screws, may be used as a jack post or a post shore in the concrete forming field. This is particularly desirable after the pouring structure has been removed and post shores are required to support the poured floor of concrete to withstand forces of material placed on the curing concrete. The shape of the leg is such that it is a compromise between the superior circular shape for load bearing capacity and the square shape which provides surfaces for mechanical connection. The corrugations in the sidewalls, that is the stepped portions, lie principally within a circle drawn to contain the stepped sidewall portions. Thus the shape in section is relatively close to the shape of a circle. It has been found that this shape has load bearing capacities greater than a rectangular section and which may approximate those of a circular section.

In addition, to increase the strength of the leg 16 of FIG. 3, the corner portions 32 are thickened so as to strengthen the corners and increase the load bearing capacity of the leg. Such thickened corner portions also resist damage to the leg, should the frame be dropped on sharp areas which could cause denting of the leg corners.

The stepped portions of the leg sidewalls, as previously explained, accommodate fasteners used in securing the brace connectors to the leg. Such accommodation leaves the leg interior substantially unobstructed to permit insertion therein of staffs and extensions on the endcaps and base plates. The staffs are so configured that their lug portions, such as 206 of FIG. 18, fit within the corners 32 to provide a snug interfit without overly complicating the design of the staff portions.

The mechanical connection of a brace arrangement to legs of a frame substantially faciliates use of the frame in the field. Because the frame can be disassembled, it can be shipped to various construction sites in a "knock-down" form. When the units arrive at the site, the legs with brace arrangement may be assembled to provide complete frames. This mechanical fastening aspect is also advantageous from the standpoint of repair, in that should one of the brace components or legs become damaged, the frame may be disassembled and the component replaced to renew the frame to its 100% full capacity. This is a distinct advantage over aluminum frames which are presently being used in the field and which are commonly interconnected by welding. As is appreciated, welding of aluminum in the field is very difficult and almost impossible. Thus should a welded aluminum frame become damaged in the field, it cannot be repaired and has to be sent to the shop for repair or may have to be scrapped.

Depending upon the end use of the frame and supporting structures, its shape for the leg may be larger or smaller. For example, when the frame is used in the concrete shorting trade, the leg is considerably larger in section that if the same leg were used for access scaffolding which has substantially lower load bearing requirements.

As to actual use of the shoring frames, the arrangement may be such that the distance between the longitudinal axes of the legs is normally set at 1.8 meters, although it may be less for example, 1.2 meters. The height of each frame leg may vary, although acceptable heights are in the range of 1.5 meters or 1.8 meters. The weight of the frames varies depending upon their use; however, with a 1.8 meter frame including slide lock assemblies, it weighs approximatey 20 kilograms, whereas the weight of a 1.4 meter frame including lock assembly weighs approximately 18 kilograms. The frame capacity of the type shown in FIG. 1, having the leg of FIG. 2, determined on a three frame high assembly, is in excess of 6,800 kilograms per leg. That is, 13,600 kilograms per frame for a structure three frames high. This provides a safety factor of at least 2.5. The spacing between the frames as determined by the cross-brace members may be greater than the known standard steel welded frame. For example, for a normal height garage floor slab of approximately 2.5 meters having a thickness of 26 centimeters and a weight of approximately 730 kilograms per square meter, this can be supported by a minumum number of shoring frames, according to this invention, giving a supported area slab of approximately 6.4 square meters per leg. With prior welded steel frames, having a one meter width, a support ratio of 4.1 square meters per leg is required.

Another comparison which may be made is that a three frame high assembly having an overall height of nearly 6 meters and an overall weight per tower (three frames) of 60 kilograms and a frame width of 1.8 meters, has a comparable loading capacity per frame, as extra heavy-duty welded steel shoring frames having the same height, a width between frame legs of approximately 1.2 meters, and weighing approximately 160 kilograms. In other words, a lower weight frame, according to this invention, will support a greater area than the much heavier welded steel shoring frames which have been used in the past. Further, shoring frames, according to the present invention, may be stacked to shoring heights of 50 meters or more, where once again the weight of the shoring in place and the amount of handling to get the shoring in place are considerably less when compared to welded steel shoring frames previously known.

Although preferred embodiments of the invention have been described herein in detail, it will be understood by those skilled in art that variations may be made thereto without departing from the spirit of the invention or the scope of the appended claims.

The embodiments of the invention in which an exclusive property or privilege is claimed are defined as follows:

1. A boltably assembled shoring frame, comprising:

a pair of legs in spaced parallel relation, each leg comprising a continuous wall portion exhibiting a generally rectangular cross section and defining a central longitudinal aperture therethrough, each side of said rectangular cross section exhibiting an outwardly stepped portion, said outwardly stepped portion providing an exterior contact face on said leg and also providing an interior recess which may at least partially accommodate bolt fasteners while maintaining maximum internal clearance within said aperture in said leg, each of said legs having apertures in said wall portions through which a bolt may extend;

a plurality of linear bracing members extending between said legs, at least two of said bracing members being each generally perpendicular to each leg and at least one bracing member extending diagonally between said legs;

a plurality of brackets, said brackets for coupling said bracing members to said legs to form substantially rigid frames, each leg having at least two of said brackets boltably attached thereto, each of said brackets including a web portion for contacting one contact face of said leg and further including two lugs for contacting two other contact faces of said leg, each of said lugs having an aperture therethrough for facilitating the bolted securing of said bracket to said legs, each bracket also including at least one lug for facilitating the boltable securing of said bracket to at least one of said bracing members;

a first plurality of bolt fasteners securing said brackets to said legs; and a second plurality of bolts fasteners securing said bracing members to said brackets.

2. The frame of claim 1, wherein each of said linear bracing members has a generally rectangular cross section.

3. The frame of claim 1, wherein said corners of said generally rectangular cross section of said leg wall portion are of increased thickness relative to the remainder of said wall portion.

4. The frame of claim 1, wherein each of said lugs of said bracket which contact said leg include two apertures in spaced relation thereon, and wherein said apertures in said legs include two apertures in said stepped portions of said leg, said two leg apertures spaced as to align with said two bracket apertures, and wherein said first plurality of boltable fasteners comprises:

a plurality of bolts extending through said aligned apertures in said legs and in said brackets; and a plurality of bolt retainers, each bolt retainer including two threaded portions for threadably retaining said bolts.

5. The frame of claim 4, wherein each of said bolt retainers is at least partially situated within one of said interior recesses in said legs.

6. The frame of claim 1, wherein at least one side of said rectangular cross section of each of said legs includes longitudinally extending ridges on each side of said outwardly stepped portion on said contact face of said leg.

7. A shoring structure, comprising:

a pair of boltably assembly shoring frames, each frame comprising, a pair of legs in spaced parallel relation, each leg comprising a continuous wall portion exhibiting a generally rectangular cross section and defining a central longitudinal aperture therethrough, each side of said rectangular cross section exhibiting an outwardly stepped portion, said outwardly stepped portion providing an exterior contact face on said leg and also providing an interior recess which may at least partially accommodate fasteners while maintaining maximum internal clearance within said aperture in said leg, a plurality of linear bracing members extending between said legs, at least two of said bracing members being each generally perpendicular to each leg and at least one bracing member extending diagonally between said legs, a plurality of brackets, each leg having at least two brackets boltably attached thereto, each of said brackets including a web portion for contacting one contact face of said leg and further including two lugs for contacting two other contact faces of said leg, each of said legs having an aperture therethrough for facilitating the bolted securing of said bracket to said legs, each bracket also including at least one lug for facilitating the boltable securing of said bracket to at least one of said linear members, said brackets coupling said bracing members to said legs to form substantially rigid frames, a first plurality of bolt fasteners securing said brackets to said legs, and a second plurality of bolt fasteners securing said brackets to said members; and means for bracing between said pair of frames to form a shoring structure.

8. The shoring structure of claim 7, wherein said means for bracing between said pair of frames comprises:

a plurality of bracing members extending diagonally between said spaced parallel frames; and means for boltably coupling said bracing members to said frames.

9. A shoring frame, comprising:

a pair of legs, each leg being defined by a substantially uninterrupted periphery in a transverse cross section, wherein each leg is of generally rectangular cross section and wherein each said leg includes four longitudinally extending wall portions which are in outwardly stepped relation to the general cross-sectional contours of said leg;

means for bracing between said legs, said bracing means including means for diagonally bracing between said legs; and means for boltably securing said bracing means to said legs, said boltable securing means adapted to engage at least two opposed wall portions of said longitudinally extending wall portions.

10. A substantially rigid shoring frame for supporting concrete forms, comprising:

a pair of legs, each leg having at least one pair of opposed longitudinally extending wall portions which are in stepped relation to the general contours of said leg;

a brace mechanism comprising a plurality of linear members, certain of said linear members being substantially perpendicular to said legs, while certain other of said linear members intersect said legs at an angle, each linear member being boltably coupled at each of its ends to one of said legs in a fixed mechanical connection to form a rigid frame; and a plurality of bolts for coupling said brace mechanism to said legs.

11. A substantially rigid shoring frame for supporting concrete forms, comprising:

a pair of legs, each leg having at least one pair of opposed longitudinally extending wall portions which are in stepped relation to the general contours of said leg;

a brace mechanism comprising at least one linear member and a plurality of brackets, each bracket adapted to be boltably secured to both said linear member and to one of said legs, each bracket having:

a web;

a pair of lugs extending from said web, said lugs adapted to engage and be boltably coupled to said wall portions of one said leg when said web is adjacent a wall portion of said leg; and at least one additional lug extending from said leg which lug is boltably coupled to said linear member thereby establishing a fixed mechanical connection with each leg to form a rigid frame; and a plurality of bolts for coupling said brace mechanism to said legs.

12. A substantially rigid shoring frame for supporting concrete forms, comprising:

a pair of legs, each leg having at least one pair of opposed longitudinally extending wall portions which are in stepped relation to the general contours of said leg, and a plurality of apertures extending through said wall portions;

a brace mechanism comprising at least one linear member and a plurality of brackets, each bracket adapted to be boltably secured to both said linear member and to one of said legs, each bracket having:

a web;

a pair of lugs extending from said web, said lugs adapted to engage and be boltably coupled through said apertures in each said leg to said wall portions of such leg when said web is adjacent a wall portion of such leg; and at least one additional lug extending from said web which is boltably coupled to said linear member thereby establishing a fixed mechanical connection with each each leg to form a rigid frame; and a plurality of bolts for coupling said brace mechanism to said legs.

* * * * *

UNITED STATES PATENT AND TRADEMARK OFFICE
CERTIFICATE OF CORRECTION

PATENT NO. : 4,841,708

DATED : June 27, 1989

INVENTOR(S) : Ronald J. Johnston

It is certified that error appears in the above-identified patent and that said Letters Patent is hereby corrected as shown below:

In column 4, line 12, "haing" should read --having--.

In column 5, line 63, "froom" should read --from--.

In column 7, line 63, "113" should read --112--.

In column 9, line 22, "126 which may" should read --166 which may--.

In column 9, line 26, "120" should read --126--.

In column 9, line 67, "189" should read --180--.

In column 10, line 26, "105" should read --205--.

In column 12, line 35, "mill" should read --sill--.

In column 13, line 60, "will" should read --with--.

In column 18, line 37, "leg" should read --web--.

Signed and Sealed this

Fourth Day of September, 1990

*Attest:*

HARRY F. MANBECK, JR.

*Attesting Officer*

*Commissioner of Patents and Trademarks*